US012258207B2

(12) United States Patent
Newman

(10) Patent No.: US 12,258,207 B2
(45) Date of Patent: Mar. 25, 2025

(54) MOBILE TOWER SYSTEM

(71) Applicant: Gerald W. Newman, Spangle, WA (US)

(72) Inventor: Gerald W. Newman, Spangle, WA (US)

( * ) Notice: Subject to any disclaimer, the term of this patent is extended or adjusted under 35 U.S.C. 154(b) by 605 days.

(21) Appl. No.: 17/496,544

(22) Filed: Oct. 7, 2021

(65) Prior Publication Data

US 2023/0116806 A1 Apr. 13, 2023

(51) Int. Cl.

| | |
|---|---|
| ***B65D 90/12*** | (2006.01) |
| ***B65D 88/02*** | (2006.01) |
| ***B65D 90/00*** | (2006.01) |
| ***E04B 1/343*** | (2006.01) |
| ***E04H 12/20*** | (2006.01) |

(52) U.S. Cl.

CPC ..... *B65D 90/125* (2013.01); *B65D 88/027* (2013.01); *B65D 90/0006* (2013.01); *E04B 1/34352* (2013.01); *E04H 12/20* (2013.01); *B65D 2590/0008* (2013.01)

(58) Field of Classification Search

CPC ... E04B 1/34352; E04H 12/20; E04H 12/345; B65D 90/125; H01Q 1/3275

USPC ..... 52/111

See application file for complete search history.

(56) References Cited

U.S. PATENT DOCUMENTS 2,237,202 A * 4/1941 Strattan ..... F21V 21/22 248/404
3,135,363 A * 6/1964 Bourassa ..... E04H 12/182 285/317
3,229,939 A * 1/1966 Hubbard ..... F21V 17/168 439/550
3,262,582 A * 7/1966 Pitman ..... E02F 9/085 280/765.1
3,958,376 A * 5/1976 Campbell ..... F21V 21/22 254/93 VA
4,815,757 A * 3/1989 Hamilton ..... B60S 9/06 348/148

(Continued)

OTHER PUBLICATIONS

Office Action for U.S. Appl. No. 16/995,610, mailed on Sep. 16, 2022, Newman, "Transportable Contained Tower System", 6 Pages.

(Continued)

*Primary Examiner* — James M Ference
(74) *Attorney, Agent, or Firm* — Lee & Hayes, P.C.

(57) ABSTRACT

A mobile tower system includes a steel shipping container. A tower structure is moveable between a substantially horizontal travel position and a substantially vertical operational position. A connection member is fixed to a lower portion of the tower structure and moveably coupled to a channel disposed in a horizontal member removeably attached to a vertical frame attached to a back wall of the steel shipping container. When the tower structure is displaced from the substantially horizontal travel position to the substantially vertical operational position, the connection member and the tower structure are linearly displaced together along the channel toward the back wall and the tower structure is pivotably displaced about the connection member, such that the upper portion of the tower structure is displaced through an opening disposed in a roof of the steel shipping container proximate a back wall of the steel shipping container.

20 Claims, 5 Drawing Sheets

(56) References Cited

U.S. PATENT DOCUMENTS 4,913,458 A * 4/1990 Hamilton ..... B60S 9/10 348/148
4,934,396 A * 6/1990 Vitta ..... E04H 1/1277 135/148
5,102,375 A * 4/1992 Featherstone ..... E04H 12/182 474/155
5,434,614 A * 7/1995 Dainty ..... H04N 23/695 348/E7.087
5,558,112 A * 9/1996 Strieter ..... B09B 3/0066 135/900
5,611,177 A * 3/1997 Herbstritt ..... B60P 3/18 212/293
5,671,900 A * 9/1997 Cutler ..... B25H 1/00 248/448
5,697,457 A * 12/1997 Back ..... E21B 7/023 173/186
5,791,857 A * 8/1998 Ziaylek, Jr. ..... E06C 5/04 182/127
5,868,218 A * 2/1999 Lawson ..... B66F 11/044 182/69.6
6,000,175 A * 12/1999 Gale ..... E04H 15/48 52/79.5
D418,413 S * 1/2000 Stern ..... D9/434
6,253,502 B1 * 7/2001 Layton ..... H01Q 1/3216 52/118
6,260,310 B1 * 7/2001 Price ..... H01Q 1/10 52/118
6,299,336 B1 * 10/2001 Hulse ..... B60Q 1/2657 362/198
6,383,242 B1 * 5/2002 Rogers ..... B01D 46/42 52/63
7,000,357 B1 * 2/2006 Stearns ..... H01Q 1/3216 52/118
7,121,745 B2 * 10/2006 Chapman ..... B66F 11/048 396/428
7,188,636 B1 * 3/2007 Kanne ..... E04G 21/243 135/900
7,299,531 B2 * 11/2007 Staples ..... G01B 3/303 29/469
7,788,858 B1 * 9/2010 Ammons ..... B66C 23/44 212/292
7,866,332 B1 * 1/2011 Mizrahi ..... B66C 23/48 52/63
7,989,979 B2 * 8/2011 Burgess ..... B60Q 1/245 307/112
8,305,287 B2 * 11/2012 Sabatino ..... H01Q 1/081 74/89.32
D707,534 S * 6/2014 Crounse ..... D8/356
8,882,441 B2 * 11/2014 Harrison ..... E04H 12/182 415/4.4
D733,262 S * 6/2015 Kang ..... D23/261
D734,205 S * 7/2015 DeYoung ..... D8/356
D738,706 S * 9/2015 Knapp ..... D8/356
D738,707 S * 9/2015 Tung ..... D8/356
9,598,875 B1 * 3/2017 Bateman ..... F21V 25/00
D789,183 S * 6/2017 Herrick ..... D8/356
D803,666 S * 11/2017 Morley ..... D8/356
D821,183 S * 6/2018 Bargetzi ..... D8/356
D831,468 S * 10/2018 Morley ..... D8/356
D837,636 S * 1/2019 Wersland ..... D8/356
10,745,930 B2 * 8/2020 Newman ..... E04B 1/34352
11,021,888 B1 * 6/2021 Smith ..... E04H 12/345
11,643,835 B2 * 5/2023 Newman ..... H01Q 1/1235 52/111
2005/0218657 A1 * 10/2005 Weesner ..... F03D 80/50 290/55
2006/0123967 A1 * 6/2006 Smitherman ..... B27B 5/10 83/651
2007/0058968 A1 * 3/2007 Chapman ..... G03B 17/02 396/428
2008/0180349 A1 * 7/2008 Newman ..... E04H 12/182 343/890
2008/0182624 A1 * 7/2008 Newman ..... H01Q 1/3216 455/561
2009/0128085 A1 * 5/2009 Yang ..... F03D 9/11 290/1 R
2010/0140949 A1 * 6/2010 Pitre ..... F03D 13/20 290/55
2012/0007365 A1 * 1/2012 Harrison ..... E04H 12/187 290/55
2014/0259986 A1 * 9/2014 Kwartler ..... E04H 12/182 52/118
2014/0370935 A1 * 12/2014 Newman ..... H01Q 1/246 455/562.1
2015/0292227 A1 * 10/2015 Gorney ..... E04H 12/2284 52/114
2015/0300321 A1 * 10/2015 Haar ..... F03D 9/255 206/223
2016/0108893 A1 * 4/2016 Agtuca ..... F03D 9/11 290/44
2016/0177590 A1 * 6/2016 Gorney ..... E04H 12/187 52/114
2017/0167157 A1 * 6/2017 Gorney ..... E04H 12/18
2018/0044154 A1 * 2/2018 Priest ..... B66F 11/04
2018/0266136 A1 * 9/2018 Gorney ..... F16M 11/42
2018/0274258 A1 * 9/2018 Newman ..... E04B 1/34352
2019/0093382 A1 * 3/2019 Sauber ..... E04H 12/187
2020/0299988 A1 * 9/2020 Newman ..... E04H 12/182
2020/0331379 A1 * 10/2020 Newman ..... B60P 1/162
2021/0032891 A1 * 2/2021 Newman ..... E04H 12/182
2021/0222676 A1 * 7/2021 Karasawa ..... F03D 13/40
2023/0116806 A1 * 4/2023 Newman ..... E04B 1/34352 220/1.5

OTHER PUBLICATIONS

Office Action for U.S. Appl. No. 16/995,610, mailed on Mar. 2, 2022, Newman, "Transportable Contained Tower System", 10 Pages.

* cited by examiner

MOBILE TOWER SYSTEM

BACKGROUND

Mobile tower systems exist that include tower structures that are shipped in a supported horizontal within a shipping container, but then may be reoriented to a vertical position for the use and/or operation of the tower structures. However, these mobile tower systems are relatively bulky and cumbersome to install at remote locations. For example, the tower structure being transported can be relatively bulky and cumbersome to reorient from the horizontal travel position to the vertical operational position. Accordingly, there remains a need for mobile tower systems that are relatively easier to install at remote locations.

SUMMARY

Mobile tower systems that may more easily be installed at remote locations are described herein. More specifically, this disclosure relates to mobile tower systems that have tower structures that are pivotably displaceable about a connection member that is moveably coupled to a structural frame inside of a steel shipping container. This summary is provided to introduce simplified concepts of mobile tower systems, which are further described below in the Detailed Description. This summary is not intended to identify essential features of the claimed subject matter, nor is it intended for use in determining the scope of the claimed subject matter.

In an embodiment, a mobile tower system includes a tower structure, having an upper portion and a lower portion, that is moveable between a substantially horizontal travel position and a substantially vertical operational position. A connection member is fixed to the lower portion of the tower structure that is moveably coupled to a structural frame. The structural frame includes a vertical frame fixed to a back wall of a shipping container and a horizontal frame removeably attached to the vertical frame. When the tower structure is positioned in the substantially vertical operational position, the vertical frame receives the lower portion of the tower structure and supports the tower structure in the substantially vertical operational position. When the tower structure is positioned in the substantially horizontal travel position the horizontal frame receives the lower portion of the tower structure and supports the tower structure in the substantially horizontal travel position. When the tower structure is displaced from the substantially horizontal travel position to the substantially vertical operational position, the connection member and the tower structure are linearly displaced together along the horizontal frame toward the back wall and the tower structure is pivotably displaced about the connection member, such that the upper portion of the tower structure is displaced through an opening disposed in a roof of the shipping container proximate the back wall of the steel shipping container.

In another embodiment, a mobile tower system includes a tower structure, having an upper portion and a lower portion, that is moveable between a substantially horizontal travel position and a substantially vertical operational position. A connection member is fixed to the lower portion of the tower structure that is moveably coupled to a channel disposed in a horizontal member removeably attached to a vertical frame attached to a back wall of the steel shipping container. When the tower structure is displaced from the substantially horizontal travel position to the substantially vertical operational position, the connection member and the tower structure are linearly displaced together along the channel toward the back wall of the steel shipping container and the tower structure is pivotably displaced about the connection member, such that the upper portion of the tower structure is displaced through an opening disposed in a roof of the steel shipping container proximate the back wall of the steel shipping container.

In another embodiment, a mobile tower system includes a tower structure, having an upper portion and a lower portion, that is moveable between a substantially horizontal travel position and a substantially vertical operational position. A roller is rotatably coupled to a pin. The pin is fixed to the lower portion of the tower structure and the roller is moveably coupled in a channel disposed in a horizontal member that is removeably attached to a vertical frame attached to a back wall of the steel shipping container. When the tower structure is displaced from the substantially horizontal travel position to the substantially vertical operational position, the roller and the tower structure are linearly displaced together along the channel toward a back wall of the steel shipping container and the tower structure is pivotably displaced about the roller, such that the upper portion of the tower structure is displaced through the opening disposed in the roof proximate the back wall of the steel shipping container.

Depending on the desired esthetic and mechanical properties of the mobile tower system components may comprise metal, plastic, and/or ceramic.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to mobile tower systems having a tower structure that is pivotably displaceable about a connection member that is moveably coupled to a structural frame inside of a steel shipping container. Because the tower structure is pivotably displaceable about a connection member that is moveably coupled to a structural frame inside of a steel shipping container, a user may quickly and easily install the mobile tower systems at remote locations.

Illustrative Mobile Tower Systems

Figure 1:
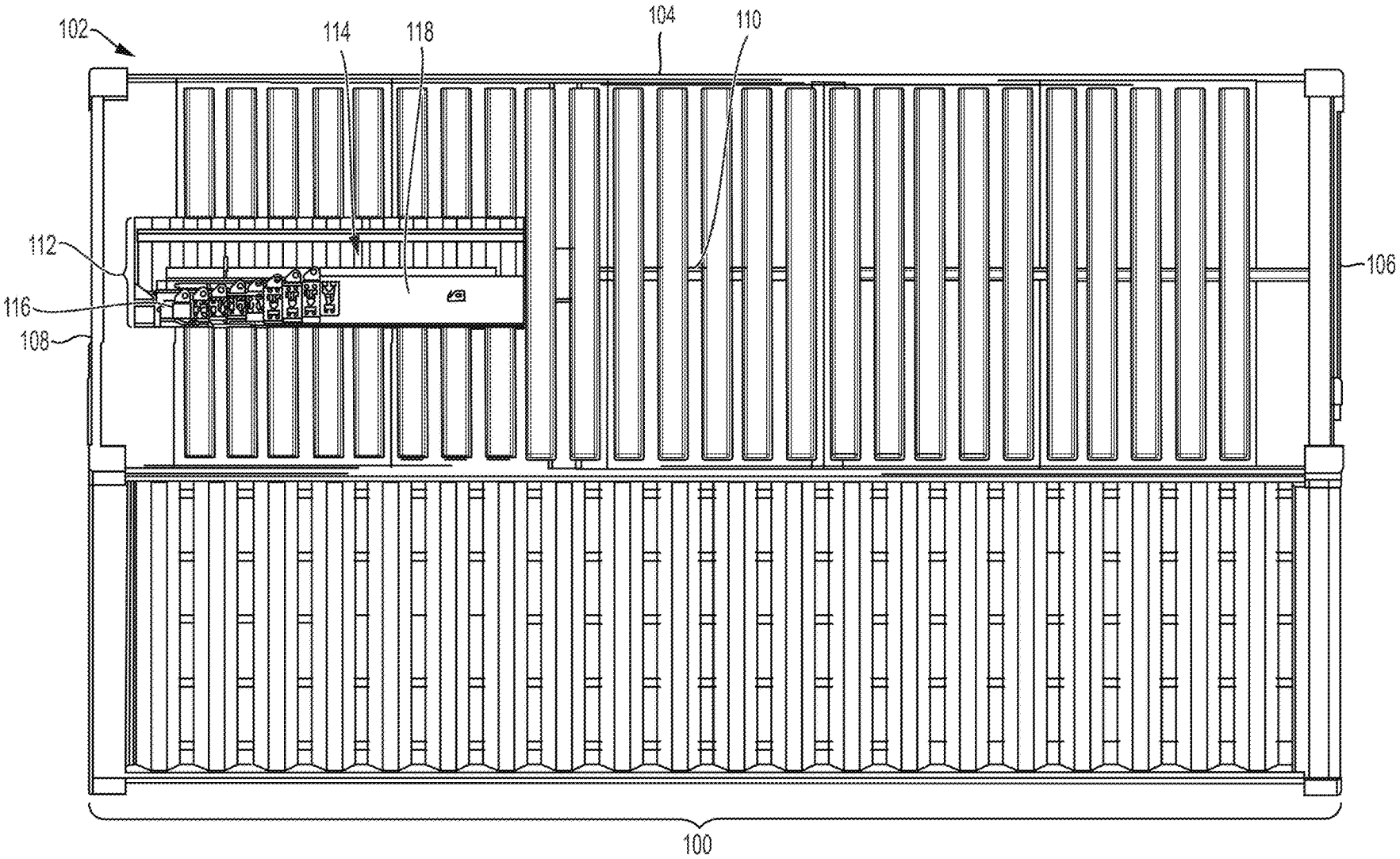
FIG. 1 illustrates a top perspective view of an exemplary mobile tower system according to an embodiment in this disclosure.

FIG. 1 illustrates a top perspective view 100 of an exemplary mobile tower system 102 according to an embodiment in this disclosure. The mobile tower system 102 may include a steel shipping container 104. The steel shipping container 104 includes a front wall 106 opposite a back wall 108, and a roof 110 extending between the front wall 106 and the back wall 108. The roof 110 has an opening 112 disposed in the roof 110 proximate the back wall 108. The mobile tower system 102 may include a cover for removeably sealing the opening 112 disposed in the roof 110.

A tower structure 114 may have an upper portion 116 and a lower portion 118 that may be moveably coupled in the steel shipping container 104. The tower structure 114 may be moveably coupled in the steel shipping container 104 such that the tower structure 114 is moveable between a substantially horizontal travel position (discussed in more detail below with regard to FIG. 2) and a substantially vertical operational position (discussed in more detail below with regard to FIG. 3). For example, in an embodiment, the tower structure 114 may include a 60' hydraulic extendable tower. In another example embodiment, the tower structure 114 may include an 80' hydraulic extendable tower. The tower structure 114 may include a plurality of members vertically aligned between a top member and a base member. The plurality of members and the top member may each extend at least a portion of a vertical distance relative to the base member. The top member, the base member, and the plurality of members may be telescoping segments. In an embodiment, each of the top member, the base member, and the plurality of members may be rectangular tubes. The top member, the base member, and/or the plurality of members may be formed of metal (e.g., steel, aluminum, titanium, etc.), composite (e.g., carbon fiber, fiberglass, etc.), plastic, etc. The tower structure 114 may include a hydraulic cylinder mounted within the tower structure.

The steel shipping container 104 may include racks fixed on inside surfaces of the container for mounting equipment thereto. For example, solar equipment, radio equipment, wireless equipment, cell equipment, batteries, generators etc. may be mounted to racks fixed on inside surfaces of the steel shipping container 104. The steel shipping container 104 may include one or more doors to provide access to the inside of the steel shipping container 104 and/or provide access to equipment mounted inside the steel shipping container 104.

Figure 2:
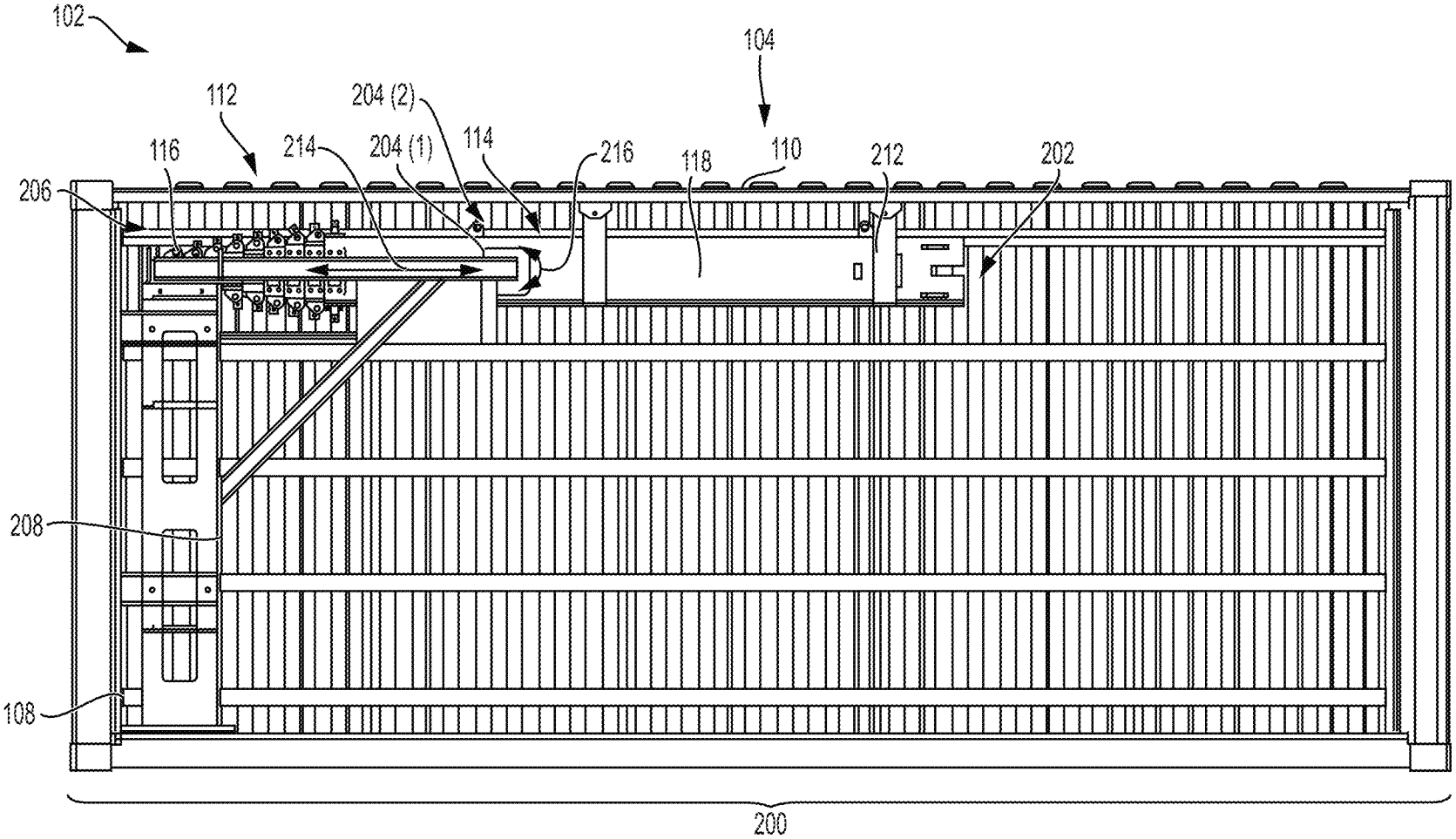
FIG. 2 illustrates a side view of the mobile tower system of FIG. 1 with a tower structure in a substantially horizontal position according to an embodiment in this disclosure.

FIG. 2 illustrates a side view 200 of the mobile tower system 102 of FIG. 1 with the tower structure 114 in a substantially horizontal travel position 202 according to an embodiment in this disclosure. FIG. 2 illustrates the steel shipping container 104 with a side wall not shown for the sake of clarity and is not intended to be limiting in any manner. One or more connection members 204(1) and 204(2) may be fixed to the lower portion 118 of the tower structure 114. For example, the one or more connection members 204(1) and 204(2) may be welded to the lower portion 118 of the tower structure 114. The one or more connection members 204(1) and 204(2) may be moveably coupled to a structural frame 206.

The structural frame 206 includes a vertical frame 208 and a horizontal frame 210. The vertical frame 208 may be fixed to the back wall 108 of the steel shipping container 104 such that, when the tower structure 114 is positioned in the substantially vertical operational position, the vertical frame 208 receives the lower portion 118 of the tower structure 114 and supports the tower structure 114 in the substantially vertical operational position (discussed in more detail below with regard to FIG. 3). The horizontal frame 210 may be removably attached to the vertical frame 208. For example, the horizontal frame 210 may be bolted to the vertical frame 208. The horizontal frame 210 may be removeably attached to the vertical frame 208 such that, when the tower structure 114 is in the substantially vertical operational position, the horizontal frame 210 may be unattached from the vertical frame 208 to provide more working space inside the steel shipping container 104. The horizontal frame 210 may be removeably attached to the vertical frame 208, such that, when the tower structure 114 is positioned in the substantially horizontal travel position 202, the horizontal frame 210 receives the lower portion 118 of the tower structure 114 and supports the tower structure 114 in the substantially horizontal travel position 202. One or more removeable support structures 212 may provide additional support for the tower structure 114 when the tower structure 114 is in the substantially horizontal travel position 202. The one or more removeable support structures 212 may be removed to displace the tower structure 114 from the substantially horizontal travel position 202 to the substantially vertical operational position. In an embodiment, when the tower structure 114 is displaced from the substantially horizontal travel position 202 to the substantially vertical operational position, the one or more connection members 204(1) and 204(2) and the tower structure 114 are linearly displaced 214 simultaneously together along the horizontal frame 210 toward the back wall 108. Moreover, when the tower structure 114 is displaced from the substantially horizontal travel position 202 to the substantially vertical operational position the tower structure 114 may also be pivotably displaced about the one or more connection members 204(1) and 204(2). The one or more connection members 204(1) and 204(2) and the tower structure 114 may be linearly displaced 214 simultaneously together along the horizontal frame 210 toward the back wall 108 while the tower structure 114 is pivotably displaced 216 about the one or more connection members 204(1) and 204(2), such that the upper portion 116 of the tower structure 114 is displaced through the opening 112 disposed in the roof 110 proximate the back wall 108 of the steel shipping container 104.

Figure 3:
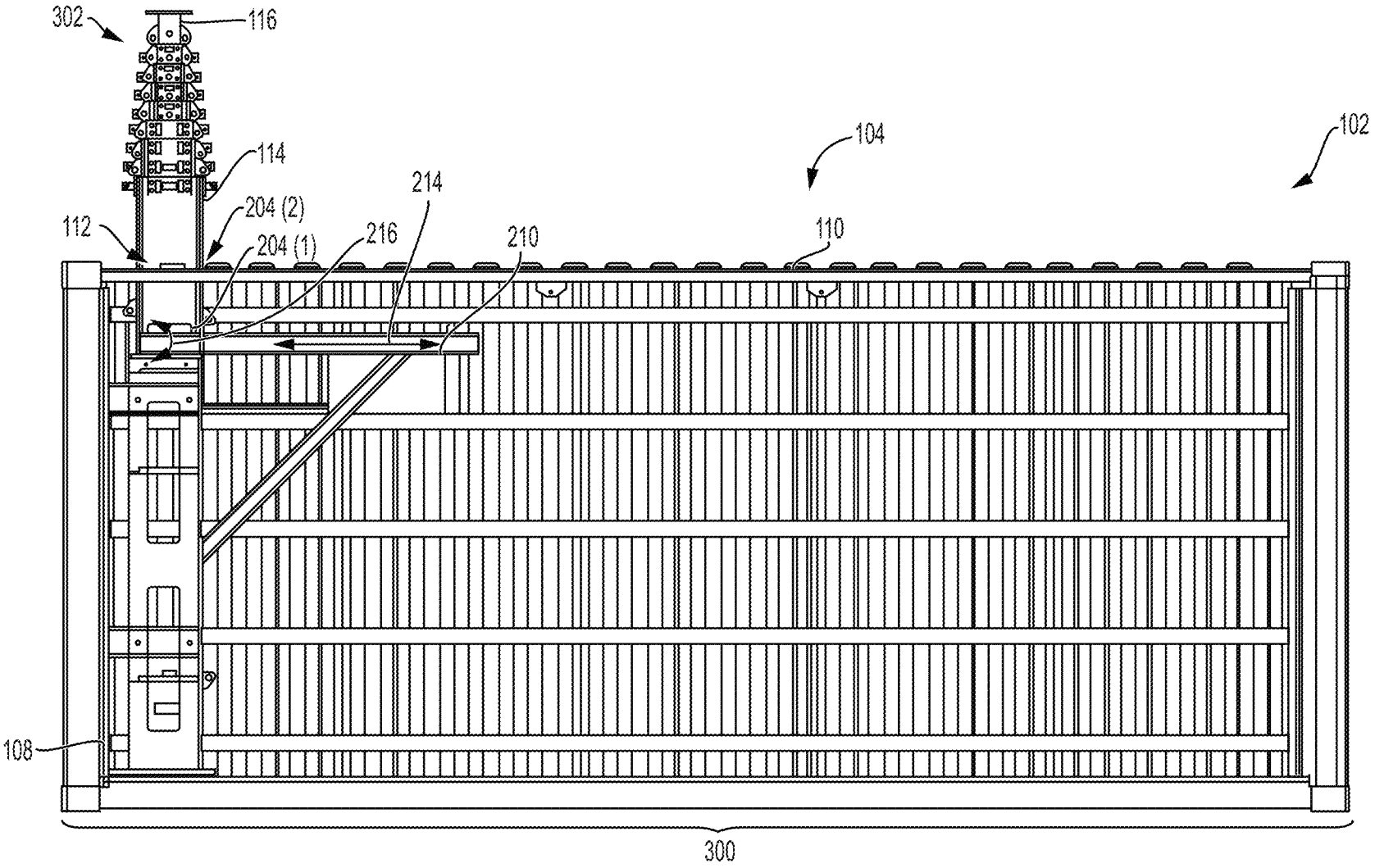
FIG. 3 illustrates a side view of the mobile tower system of FIG. 1 with the tower structure in a substantially vertical position according to an embodiment in this disclosure.

FIG. 3 illustrates a side view 300 of the mobile tower system 102 of FIG. 1 with the tower structure 114 in a substantially vertical operational position 302 according to an embodiment in this disclosure. Similar to FIG. 2, FIG. 3 illustrates the steel shipping container 104 with the side wall not shown for the sake of clarity and is not intended to be limiting in any manner. FIG. 3 illustrates the vertical frame 208 receives the lower portion 118 of the tower structure 114 and supports the tower structure 114 in the substantially vertical operational position 302. When the tower structure 114 is positioned in the substantially vertical operational position 302, the tower structure is extendable a vertical distance via a hydraulic cylinder mounted within the tower structure 114. FIG. 3 illustrates when the tower structure 114 is displaced from the substantially horizontal travel position 202 to the substantially vertical operational position 302, the one or more connection members 204(1) and 204(2) and the tower structure 114 are linearly displaced 214 together along the horizontal frame 210 toward the back wall 108 and the tower structure 114 is pivotably displaced 216 about the one or more connection members 204(1) and 204(2), such that the upper portion 116 of the tower structure 114 is displaced through the opening 112 disposed in the roof 110 proximate the back wall 108 of the steel shipping container 104. One or more wenches and cables may be mounted in the steel shipping container 104 to assist in moving the tower structure 114 from the substantially horizontal travel position 202 to the substantially vertical operational position 302. As discussed above, the horizontal frame 210 may be unattached from the vertical frame 208 to provide more working space inside the steel shipping container 104.

Figure 4:
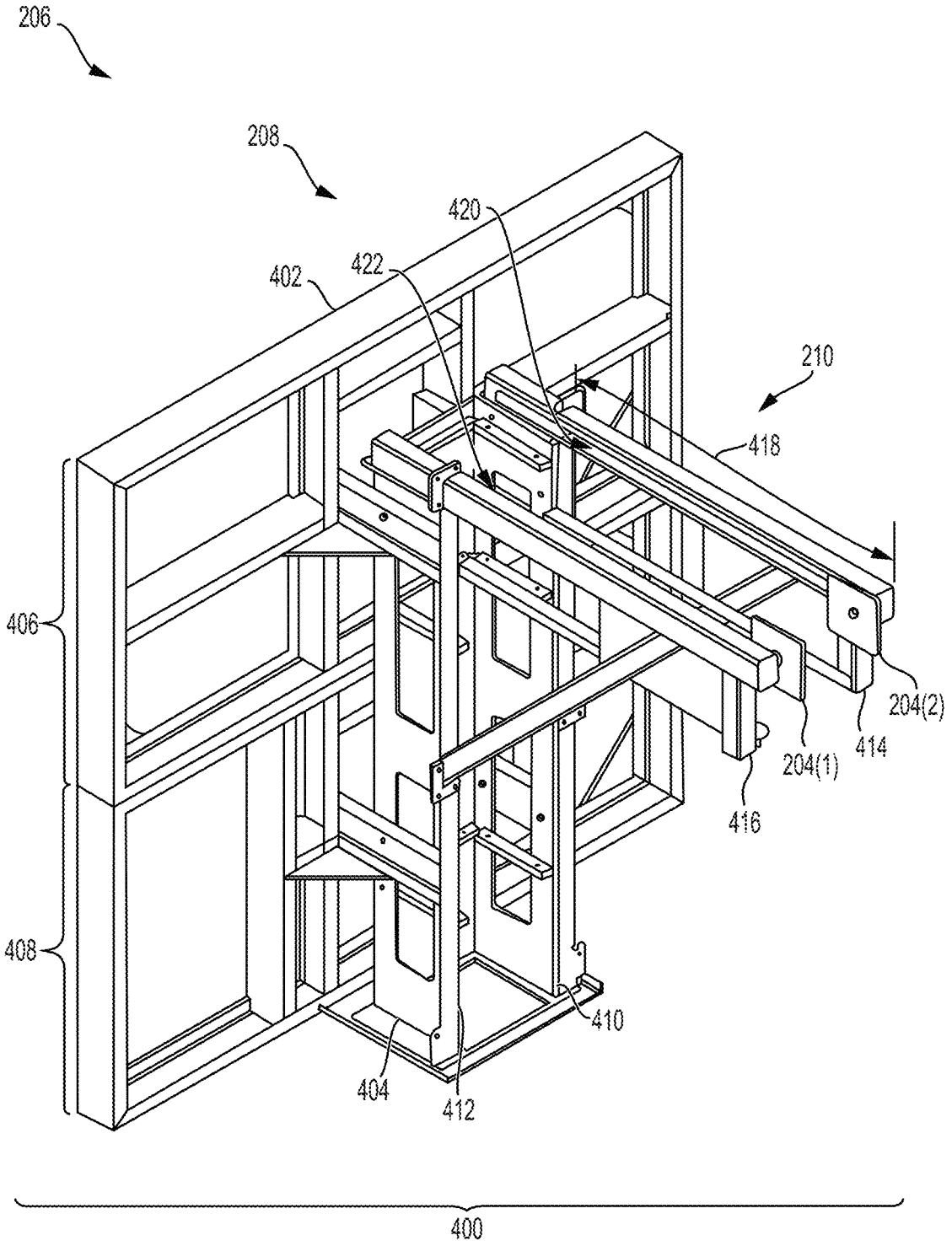
FIG. 4 illustrates a perspective view of a structural frame of the mobile tower system of FIG. 1 according to an embodiment in this disclosure.

FIG. 4 illustrates a perspective view 400 of the structural frame 206 of FIG. 2 according to an embodiment in this disclosure. FIG. 4 illustrates the vertical frame 208 including a first portion 402 and a second portion 404. The first portion 402 of the vertical frame 208 may be configured to be fixed to the back wall 108 of the steel shipping container 104. For example, the first portion 402 of the vertical frame 208 may be welded to the back wall 108 of the steel shipping container 104. The first portion 402 of the vertical frame 208 may be welded to at least both of the two corner support structures of the back wall 108 of the steel shipping container 104. The first portion 402 of the vertical frame 208 may include a top portion 406 and a bottom portion 408. The top portion 406 and the bottom portion 408 may be prefabricated. The top portion 406 and the bottom portion 408 may be sized such that one or more users may carry the top portion 406 and/or the bottom portion 408 into the steel shipping container to be welded to the back wall 108 of the steel shipping container 104. The top portion 406 may be welded to an upper portion of the back wall 108 of the steel shipping container 104. The bottom portion 408 may be welded to a lower portion of the back wall 108 of the steel shipping container 104 below the top portion 406 welded to the upper portion of the back wall 108 of the steel shipping container 104. A wall (e.g., a false wall) may be used to cover the first portion 402 of the vertical frame 208 inside of the steel shipping container 104. The second portion 404 of the vertical frame 208 may be fixed to the first portion 402 of the vertical frame 208. The second portion 404 of the vertical frame 208 may be formed of a structurally continuous unit of metal such that the second portion 404 is defined by a first protrusion 410 connected in parallel to a second protrusion 412. For example, the second portion 404 of the vertical frame 208 may be formed of a structurally continuous unit of sheet metal such that the second portion 404 is defined by the first protrusion 410 connected in parallel to the second protrusion 412. When the tower structure 114 is positioned in the substantially vertical operational position 302, the lower portion 118 of the tower structure 114 is positioned in the second portion 404 of the vertical frame 208 between the first protrusion 410 and the second protrusion 412. Subsequent to positioning the tower structure 114 in the substantially vertical operational position 302, one or more brackets may be attached to the first protrusion 410 and the second protrusion 412 of the second portion 404 of the vertical frame 208. The bracket attached to the first protrusion 410 and the second protrusion 412 may hold the lower portion 118 of the tower structure 114 between the first protrusion 410 and the second protrusion 412.

FIG. 4 illustrates the horizontal frame 210 may include a first horizontal member 414 and a second horizontal member 416. The first horizontal member 414 and the second horizontal member 416 have a longitudinal length 418 extending between a first end opposite a second end. The first horizontal member 414 may include a first channel 420 disposed in the first horizontal member 414 and extends the longitudinal length 418 between the first end and the second end of the first horizontal member 414. Similarly, the second horizontal member 416 may include a second channel 422 disposed in the second horizontal member 416 and extends the longitudinal length 418 between the first end and the second end of the second horizontal member 416.

FIG. 4 illustrates the one or more connection members 204(1) and 204(2) are each moveably coupled in the first and second channels 420 and 422. The one or more connection members 204(1) and 204(2) may be moveably coupled in the first and second channels 420 and 422 such that the first and second channels 420 and 422 guide each of the one or more connection members 204(1) and 204(2) linearly along the longitudinal length 418 between the first end and the second end of the first and second horizontal members 414 and 416. For example, when the tower structure 114 is displaced from the substantially horizontal travel position 202 to the substantially vertical operational position 302, the first and second channels 420 and 422 guide each of the one or more connection members 204(1) and 204(2) linearly along the longitudinal length 418 between the first end and the second end of the first and second horizontal members 414 and 416.

Figure 5:
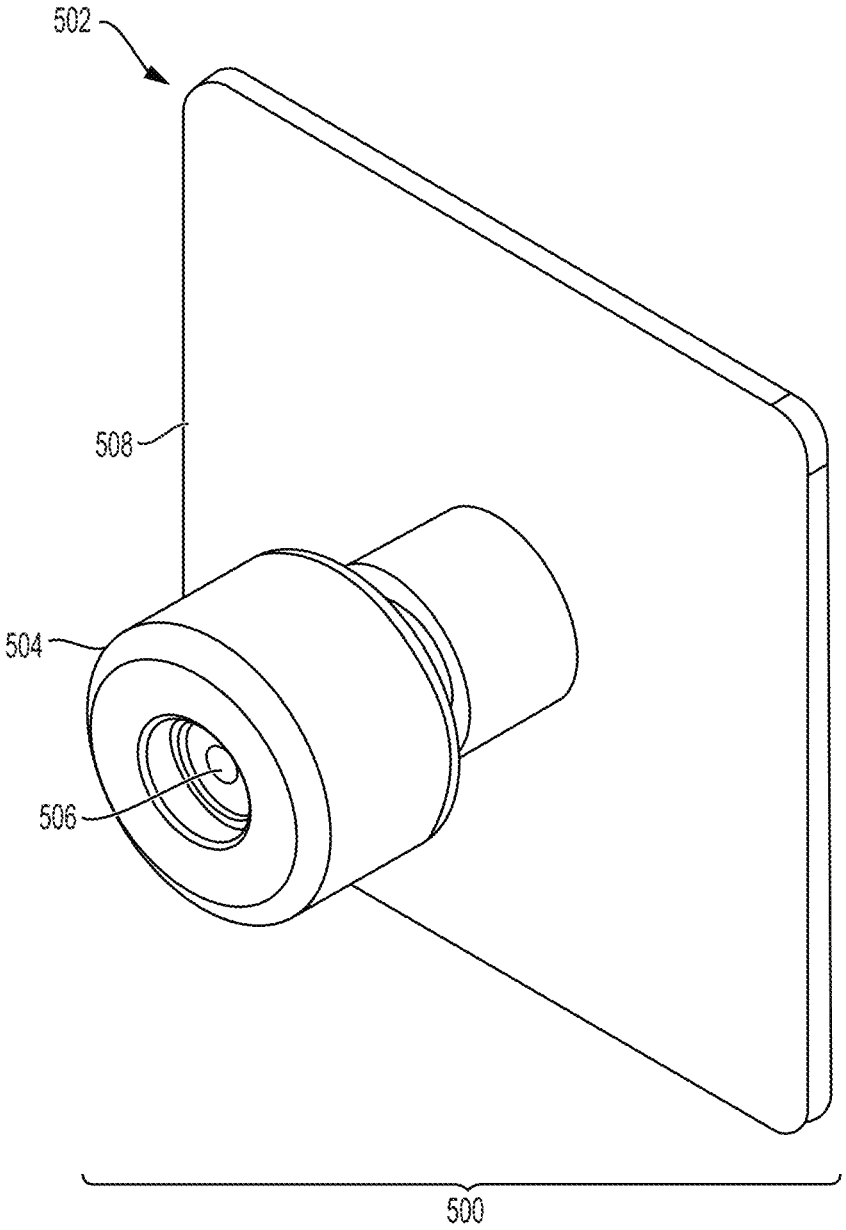
FIG. 5 illustrates a perspective view of an example connection member according to an embodiment in this disclosure.

FIG. 5 illustrates a perspective view 500 of an example connection member 502 according to an embodiment in this disclosure. The connection member 502 may be the same as or similar to the one or more connection members 204(1) and 204(2) and may include a roller pin feature, such as, for example, a roller 504 rotatably attached to a pin 506. Further, the pin 506 may be fixed to a plate 508, and the roller 504 of the connection member 502 may be moveably received by the first channel 420 or the second channel 422. Moreover, the plate 508 may be fixed to the lower portion 118 of the tower structure 114. Thus, in an embodiment where the roller 504 is rotatably attached to the pin 506 and the plate 508 is fixed to the lower portion 118 of the tower structure 114, the connection member 502 and the tower structure 114 are linearly displaceable simultaneously together along the horizontal frame, and the tower structure 114 is pivotably displaceable about the roller 504 of the connection member 502.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative.

What is claimed is:

1. A mobile tower system comprising:

a steel shipping container including:

a front wall opposite a back wall, and a roof extending between the front wall and the back wall, the roof having an opening disposed in the roof proximate the back wall;

a tower structure having an upper portion and a lower portion, the tower structure moveable between a substantially horizontal travel position and a substantially vertical operational position;

a roller rotatably coupled to a pin, the pin fixed to the lower portion of the tower structure, the roller moveably coupled to a structural frame, and the structural frame including:

a vertical frame fixed to the back wall of the shipping container, such that when the tower structure is positioned in the substantially vertical operational position, the vertical frame receives the lower portion of the tower structure and supports the tower structure in the substantially vertical operational position, wherein the vertical frame includes:

a first portion fixed to the back wall of the shipping container, and a second portion fixed to the first portion, the second portion being formed of a structurally continuous unit of sheet metal such that the second portion is defined by a first protrusion connected in parallel to a second protrusion, and wherein when the tower structure is positioned in the substantially vertical operational position, the lower portion of the tower structure is positioned in the second portion of the vertical frame between the first protrusion and the second protrusion, and a horizontal frame removeably attached to a top portion of the vertical frame, such that, when the tower structure is positioned in the substantially horizontal travel position, the horizontal frame receives the lower portion of the tower structure and supports the tower structure in the substantially horizontal travel position proximate to the opening disposed in the roof proximate the back wall of the steel shipping container, wherein when the tower structure is displaced from the substantially horizontal travel position to the substantially vertical operational position, the roller and the tower structure are linearly displaced together along the horizontal frame toward the back wall and the tower structure is pivotably displaced about the roller, such that the upper portion of the tower structure is displaced through the opening disposed in the roof proximate the back wall of the steel shipping container.

2. The mobile tower system of claim 1, wherein the horizontal frame includes:

a horizontal member extending between a first end opposite a second end, and a channel disposed in the horizontal member and extending between the first end and the second end of the horizontal member, wherein the roller is moveably coupled in the channel such that the channel guides the roller linearly along the horizontal member between the first end and the second end thereof when the tower structure is displaced from the substantially horizontal travel position to the substantially vertical operational position.

3. The mobile tower system of claim 2, wherein the horizontal member is a first horizontal member, the channel is a first channel disposed in the first horizontal member, and the roller is a first roller, wherein the horizontal frame further includes:

a second horizontal member extending between a first end of the second horizontal member opposite a second end of the second horizontal member, and a second channel disposed in the second horizontal member and extending between the first end and the second end of the second horizontal member, and wherein a second roller is moveably coupled in the second channel such that the second channel guides the second roller linearly along the second horizontal member between the first end and the second end thereof when the tower structure is displaced from the substantially horizontal travel position to the substantially vertical operational position.

4. The mobile tower system of claim 1, further comprising a bracket attachable to the first protrusion and the second protrusion of the second portion of the vertical frame when the horizontal frame is removed from the vertical frame, the bracket holding the lower portion of the tower structure between the first protrusion and the second protrusion.

5. The mobile tower system of claim 1, further comprising a hydraulic cylinder mounted within the tower structure, wherein when the tower structure is positioned in the substantially vertical operational position, the tower structure is extendable a vertical distance via the hydraulic cylinder.

6. The mobile tower system of claim 1, further comprising one or more removeable support structures attached to the roof and the tower structure, wherein when the tower structure is displaced from the substantially horizontal travel position to the substantially vertical operational position the one or more removeable support structures are removed to displace the tower structure from the substantially horizontal travel position to the substantially vertical operational position.

7. The mobile tower system of claim 1, wherein when the tower structure is positioned in the substantially vertical operational position, the horizontal frame is unattached from the vertical frame.

8. A mobile tower system comprising:

a steel shipping container including:

a front wall opposite a back wall, and a roof extending between the front wall and the back wall, the roof having an opening disposed in the roof proximate the back wall, a tower structure having an upper portion and a lower portion, the tower structure moveable between a substantially horizontal travel position and a substantially vertical operational position, a roller rotatably coupled to a pin, the pin fixed to the lower portion of the tower structure and the roller moveably coupled to a channel, the channel disposed in a horizontal member of a horizontal frame removeably attached to a top portion of a vertical frame, the vertical frame including:

a first portion fixed to the back wall of the shipping container, and a second portion fixed to the first portion, the second portion being formed of a structurally continuous unit of sheet metal such that the second portion is defined by a first protrusion connected in parallel to a second protrusion, wherein when in the substantially horizontal travel position, the horizontal frame receives the lower portion of the tower structure and supports the tower structure in the substantially horizontal travel position proximate to the opening disposed in the roof proximate the back wall of the steel shipping container;

wherein when the tower structure is displaced from the substantially horizontal travel position to the substantially vertical operational position, the roller and the tower structure are linearly displaced together along the channel toward the back wall and the tower structure is pivotably displaced about the roller, such that the upper portion of the tower structure is displaced through the opening disposed in the roof proximate the back wall of the steel shipping container; and wherein when the tower structure is positioned in the substantially vertical operational position, the lower portion of the tower structure is positioned in the second portion of the vertical frame between the first protrusion and the second protrusion.

9. The mobile tower system of claim 8, wherein the horizontal member is a first horizontal member of the horizontal frame, the channel is a first channel disposed in the first horizontal member, the roller is a first roller, and the mobile tower system further including:

a second roller fixed to the lower portion of the tower structure and moveably coupled to a second channel, the second channel disposed in a second horizontal member of the horizontal frame removeably attached to the top portion of the vertical frame attached to the back wall of the steel shipping container, and wherein when the tower structure is displaced from the substantially horizontal travel position to the substantially vertical operational position, the first and second rollers and the tower structure are linearly displaced together along the first and second channels toward the back wall and the tower structure is pivotably displaced about the first and second rollers, such that the upper portion of the tower structure is displaced through the opening disposed in the roof proximate the back wall of the steel shipping container.

10. The mobile tower system of claim 8, further comprising a bracket attachable to the first protrusion and the second protrusion of the second portion of the vertical frame when the horizontal frame is removed from the vertical frame, the bracket holding the lower portion of the tower structure between the first protrusion and the second protrusion.

11. The mobile tower system of claim 8, wherein the first portion fixed to the back wall of the shipping container includes a prefabricated top portion fixed to a top half of the back wall and a prefabricated bottom portion fixed to a bottom half of the back wall.

12. The mobile tower system of claim 8, further comprising a hydraulic cylinder mounted within the tower structure, and wherein when the tower structure is positioned in the substantially vertical operational position, the tower structure is extendable a vertical distance via the hydraulic cylinder.

13. The mobile tower system of claim 8, further comprising one or more removeable support structures attached to the roof and the tower structure, wherein when the tower structure is displaced from the substantially horizontal travel position to the substantially vertical operational position the one or more removeable support structures are removed to displace the tower structure from the substantially horizontal travel position to the substantially vertical operational position.

14. The mobile tower system of claim 8, wherein when the tower structure is positioned in the substantially vertical operational position, the horizontal frame is unattached from the vertical frame.

15. A mobile tower system comprising:

a steel shipping container including:

a front wall opposite a back wall, and a roof extending between the front wall and the back wall, the roof having an opening disposed in the roof proximate the back wall, a tower structure having an upper portion and a lower portion, the tower structure moveable between a substantially horizontal travel position and a substantially vertical operational position;

a roller rotatably coupled to a pin, the pin fixed to the lower portion of the tower structure and the roller moveably coupled in a channel, the channel disposed in a horizontal member of a horizontal frame removeably attached to a top portion of a vertical frame, the vertical frame including:

a first portion fixed to the back wall of the shipping container, and a second portion fixed to the first portion, the second portion being formed of a structurally continuous unit of sheet metal such that the second portion is defined by a first protrusion connected in parallel to a second protrusion, wherein when in the substantially horizontal travel position, the horizontal frame receives the lower portion of the tower structure and supports the tower structure in the substantially horizontal travel position proximate to the opening disposed in the roof proximate the back wall of the steel shipping container;

wherein when the tower structure is displaced from the substantially horizontal travel position to the substantially vertical operational position, the roller and the tower structure are linearly displaced together along the channel toward the back wall and the tower structure is pivotably displaced about the roller, such that the upper portion of the tower structure is displaced through the opening disposed in the roof proximate the back wall of the steel shipping container; and wherein when the tower structure is positioned in the substantially vertical operational position, the lower portion of the tower structure is positioned in the second portion of the vertical frame between the first protrusion and the second protrusion.

16. The mobile tower system of claim 15, wherein the horizontal member is a first horizontal member of the horizontal frame, the channel is a first channel disposed in the first horizontal member, the roller is a first roller, the pin is a first pin, and the mobile tower system further including:

a second roller rotatably coupled to a second pin, the second pin fixed to the lower portion of the tower structure and the second roller moveably coupled in a second channel, the second channel disposed in a second horizontal member of the horizontal frame removeably attached to the top portion of the vertical frame, wherein when the tower structure is displaced from the substantially horizontal travel position to the substantially vertical operational position, the first and second rollers and the tower structure are linearly displaced together along the first and second channels toward the back wall and the tower structure is pivotably displaced about the first and second rollers, such that the upper portion of the tower structure is displaced through the opening disposed in the roof proximate the back wall of the steel shipping container.

17. The mobile tower system of claim 15, further comprising a bracket attachable to the first protrusion and the second protrusion of the second portion of the vertical frame when the horizontal frame is removed from the vertical frame, the bracket holding the lower portion of the tower structure between the first protrusion and the second protrusion.

18. The mobile tower system of claim 15, wherein the first portion fixed to the back wall of the shipping container includes a prefabricated top portion fixed to a top half of the back wall and a prefabricated bottom portion fixed to a bottom half of the back wall.

19. The mobile tower system of claim 15, further comprising a hydraulic cylinder mounted within the tower structure, and wherein when the tower structure is positioned in the substantially vertical operational position, the tower structure is extendable a vertical distance via the hydraulic cylinder.

20. The mobile tower system of claim 15, wherein when the tower structure is positioned in the substantially vertical operational position, the horizontal frame is unattached from the vertical frame.

* * * * *